US005131428A

United States Patent [19]

Bory

[11] Patent Number: 5,131,428

[45] Date of Patent: Jul. 21, 1992

[54] FAUCET WITH UNITARY UNDERBODY

[75] Inventor: Steven Bory, Lake Forest, Ill.

[73] Assignee: Injecto Mold, Inc., Chicago, Ill.

[21] Appl. No.: 787,735

[22] Filed: Nov. 4, 1991

Related U.S. Application Data

[63] Continuation of Ser. No. 662,950, Mar. 1, 1991, abandoned.

[51] Int. Cl.[5] ..... F16K 11/10

[52] U.S. Cl. ..... 137/606; 137/801; 251/366

[58] Field of Search ..... 137/801, 606; 251/366

[56] References Cited

U.S. PATENT DOCUMENTS

| | | | |
|---|---|---|---|
| 2,591,991 | 4/1952 | Young | 137/801 |
| 3,520,325 | 7/1970 | Stuart . | |
| 3,998,240 | 12/1976 | Liautaud | 137/606 X |
| 4,026,328 | 5/1977 | Nelson | 137/801 |
| 4,040,670 | 8/1977 | Williams . | |
| 4,090,283 | 5/1978 | Woolley . | |
| 4,385,025 | 5/1983 | Salerno . | |
| 4,485,065 | 11/1984 | Hataxeyama et al. . | |
| 4,502,165 | 3/1985 | Szemeredi | 137/801 |
| 4,553,562 | 11/1985 | Nakada . | |

*Primary Examiner*—Alan Cohan
*Attorney, Agent, or Firm*—Gerstman & Ellis, Ltd.

[57] ABSTRACT

A faucet having a single piece underbody comprising a unitary injection-molded structure is provided. A tubular waterway within the faucet underbody provides a leakproof path for water through the faucet to an outlet. Further, an injection molding procedure in which a tubular waterway is formed and in turn placed into a second mold, whereupon a second injection-molding is made, is provided. The procedure allows the formation of a unitary faucet underbody resistant to leakage and conducive to quick and inexpensive installation and replacement.

10 Claims, 1 Drawing Sheet

FAUCET WITH UNITARY UNDERBODY

This application is a continuation of Ser. No. 07/662,950 filed Mar. 1, 1991 and now abandoned.

FIELD OF THE INVENTION

The present invention concerns a novel faucet and a method of construction.

BACKGROUND OF THE INVENTION

Prior art faucets, widely in use today, are typically of the kind whose underbody structures are made of a number of separate parts joined together to form a structure through which water may flow. The number of parts are generally provided with O-rings between them to help prevent water leakage. Generally, this water leakage prevention is not reliable possibly causing water waste, messy spillage and degradation of parts through corrosion from exposure to water. Even where the O-rings are successful in preventing leakage, eventually the soft rubber from which they are made may be corrupted by age and exposure to water.

Attempts to remedy these problems have been generally unsuccessful. In Liautaud U.S. Pat. No. 3,998,240, a plastic core, providing a plurality of pathways for water, is imbedded within an outerbody that serves as the exterior of the faucet. The Liautaud plastic core replaces the multiple tubular members of the typical faucet but is complex and seemingly difficult to manufacture. Leakage is likely better controlled in Liautaud than in the typical faucet but as the outer body serves as the exterior faucet and is also an element of the inner workings of the faucet, should breakage occur, the entire unit would most likely need replacing.

In Stuart, U.S. Pat. No. 3 ,520,325, a similar solution to Liautaud is presented. The device of the this patent is similar to Liautaud in that the exterior fixture is part of the inner workings of the faucet. Instead of having a plastic core, however, a metal conduit is provided. Here, as in Liautaud, the problem of replacing the entire fixture occurs and is compounded by the added cost of fabricating a metal core. Additionally, the problems of incompatibility of different materials, between the metal core and plastic exterior, exasperated by the corrosive nature of water and the forces of flowing water, could cause a rapid degradation of the system.

Because faucet housings are decorative they are relatively expensive and often match other fixtures in a bathroom or throughout a house. Fixtures are often bought together so that they match and make a pleasing combination in a room. The need to replace the entire Liautaud or Stuart device could prove expensive in that current matching fixtures would also need replacement, even though not broken, in order for them to continue to match. The ability to repair such fixtures by replacing inner workings instead of replacing entire fixtures, and all of the matching fixtures in a room, would be cost and labor efficient.

I have discovered a novel faucet having an underbody that is of a one piece design which is durable and leakproof and which can be efficiently and inexpensively replaced if damaged. When made modularly to fit a variety of current model faucet housings, the present invention would make the replacement of worn or broken faucet components a quick and easy task. Simply replacing an underbody instead of having a broken or leaking underbody examined, analyzed and repaired is less costly in labor, and provides a more durable leak proof repair needing less maintenance in the future. Also, the ability to replace the inner workings of a faucet which matches other fixtures alleviates the need for the costly replacement of all fixtures.

It is therefore an object of the present invention to provide a faucet with an underbody that is easy and inexpensive to manufacture, leakproof, modular in design and can be quickly and efficiently repaired by simple replacement.

It is a further object of the present invention to provide faucet underbodies for fixtures in current use, so that upon breakage of those fixtures, a single piece underbody can be inserted into the present housing, allowing that housing to be kept and the time and labor of replacement of the inner workings to be minimized.

Other objects and advantages of the present invention will become apparent as the description proceeds.

SUMMARY OF THE INVENTION

In accordance with the present invention, a faucet is provided having a housing with a spout and a handle. A control valve and means to attach the control valve to the handle are also provided. A single piece faucet underbody is carried within the housing, comprising a unitary molded structure with an outlet for fluid and a tubular port defining an inlet for fluid. The tubular port comprises a bottom opening disposed to couple a pipe thereto, and a top opening having means disposed for coupling to the control valve.

A tubular waterway is provided within the faucet underbody, positioned to carry fluid from the port to the outlet, in this way, fluid entering the port and passing through the control valve, by manipulation of the handle, is directed to the outlet.

In the illustrative embodiment two handles, two control valves and two tubular ports are provided for a faucet that is attached, at the bottom opening of its tubular ports, to two pipes, preferably a hot water pipe and a cold water pipe.

In the illustrative embodiment, the unitary molded structure is injection molded of plastic or other resins over the tubular waterway, which is itself molded of plastic in a first molding procedure. Core pins molded on the tubular waterway provide increased strength to the underbody structure as the core pins are surrounded by and thereby imbedded in the injection-molding material during a second molding procedure in which the underbody is completed. The combination of the two molding procedures provides a single piece faucet underbody which provides a leak proof structure for the faucet of the present invention and, in a further application, can be made modular to fit into present faucet housings and thus replace worn fixture parts.

A more detailed explanation of the invention is provided in the following description and claims, and is illustrated in the accompanying drawings.

DETAILED DESCRIPTION OF THE ILLUSTRATIVE EMBODIMENT

Figure 1:
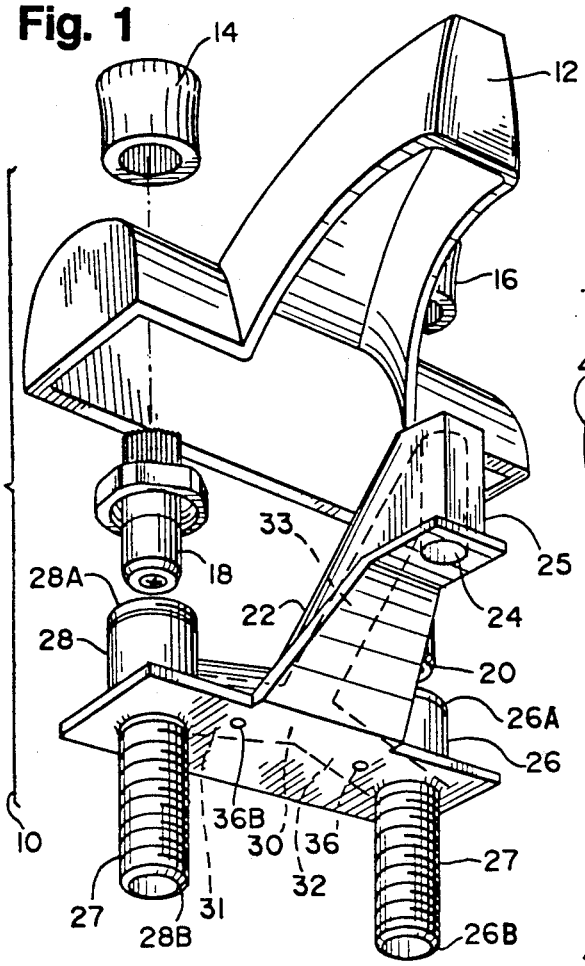
FIG. 1 is an exploded perspective view of a faucet constructed in accordance with the present invention.
Figure 2:
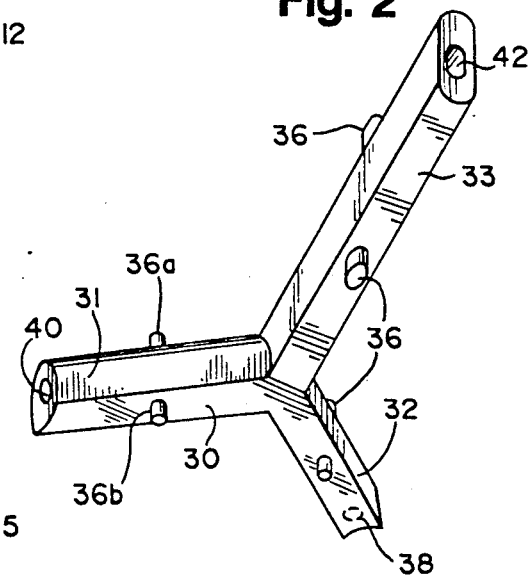
FIG. 2 is a perspective view of a tubular waterway.

Referring to the drawings, a faucet 10 is provided having a housing 12, a first handle 14 and a second handle 16, a first flow control valve 18 and a second flow control valve 20 and a single piece faucet underbody 22. The underbody 22 comprises a unitary molded structure, injection-molded of plastic, preferably acetal a plastic-type material sold under the trademarks DELRIN by DuPont and CELCON by Hoechst-Celanese, having an outlet 24 within a spout 25. A first tubular port 26 and a second tubular port 28 are provided as inlets for water.

At the top of the two tubular ports 26, 28 are openings 26A and 28A, respectively, allowing the coupling of the underbody 22 to the flow control valves 20, 18. The bottom of the tubular ports 26 and 28 are also provided with openings 26B and 28B, respectively, and having threads 27 allowing the coupling of the faucet to water pipes.

A plastic tubular waterway 30 is provided within the underbody 22 comprising a passage for water from the tubular ports 26 and 28 through the flow control valves 18 and 20 to the outlet 24. The tubular waterway 30 is preferably injection-molded of acetal and has a plurality of core pins 36 on the waterway legs 31, 32 and 33. The tubular waterway 30 comprises tubular passages 38, 40 and 42.

Figure 3:
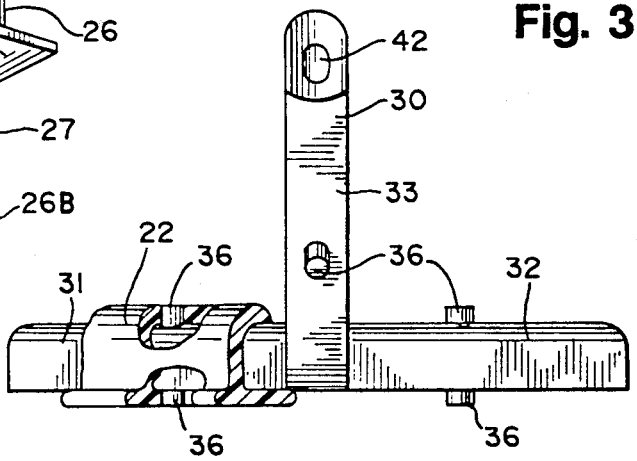
FIG. 3 is a perspective view of a faucet underbody greatly cut away to expose the tubular waterway upon which it has been molded.

FIG. 3 is illustrative of the bond formed by the injection-molding process, whereby underbody 22 is molded, preferably injection-molded, over the tubular waterway 30 and core pins 36 protrude into the material of the underbody 22. The core pins 36 are imbedded in the material of the underbody 22 during the molding process, anchoring the tubular waterway 30 to the underbody 22, and thus provide transverse strength to the entire underbody allowing resistance to the forces of flowing water.

Figure 4:
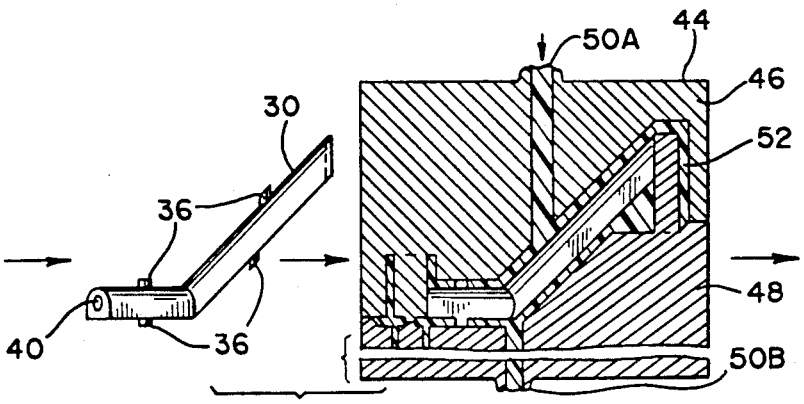
FIG. 4 is a diagrammatic view of the injection molding process of the present invention.

FIG. 4 shows a diagrammatic view of the injection-molding process, in which a tubular waterway 30, previously injection-molded, having core pins 36, is inserted into a mold 44. The mold 44 is made up of at least two parts 46 and 48 which are separated to receive a tubular waterway 30 and then closed. The mold 44 has at least two injection ports 50A and 50B whereby molten material is injected into the mold 44, over a tubular waterway 30. Upon the cooling of the injected material, the mold parts 46 and 48 are separated revealing the underbody 22.

When the underbody 22 is assembled within said faucet housing 12 and the control valves 18 and 20 are coupled to handles 14 and 16 and water pipes are coupled to ports 26 and 28, a novel and highly effective faucet 10 is produced. Handles 14 and 16 can then be manipulated to open or close control valves 18 and 20 allowing water into ports 26 and 28, through the control valves 18 and 20, into the tubular waterway 30 and out through outlet 24.

Although an illustrative embodiment of the invention has been shown and described it is to be understood that various modifications may be made to the present invention by those skilled in the art without departing from the novel scope of the present invention.

What is claimed is:

1. A faucet comprising:

a housing having a main portion and an outlet portion, said main portion defining a first opening for a first bottom, said outlet portion defining a second opening for a second bottom;

a handle, carried by said housing;

a control valve;

means attaching said control valve to said handle;

a single piece faucet underbody, carried within said housing, comprising a unitary molded structure having a flat first bottom and an elongated second bottom contiguous to said flat first bottom, said flat first bottom being received by said main portion of said housing, said elongated second bottom being received by said outlet portion of said housing, said molded structure having a tubular port with a top opening and a bottom opening, said bottom opening defining an inlet for fluid, means for coupling said port at said bottom opening to a pipe, means for coupling said port at said top opening to said control valve, means defining an outlet in said molded structure; and a tubular waterway located within said molded structure, carried above said flat first bottom and said elongated second bottom, positioned to carry fluid from said port to said outlet, whereby fluid entering said port and passing through said control valve, by manipulation of said handle, is directed to said outlet.

2. A faucet as described in claim 1, wherein said elongated second bottom is shaped to fit flush into said second opening defined by said outlet portion of said housing.

3. A faucet as described in claim 1 wherein all parts of the faucet underbody and the tubular waterway are constructed of plastic.

4. A faucet as described in claim 1 wherein said tubular waterway is a one piece unitary molded structure.

5. A faucet comprising:

a housing having a main portion and an outlet portion, said main portion defining a first opening for a first bottom, said outlet portion defining a second opening for a second bottom;

a handle carried by said housing;

a control valve;

means attaching said control valve to said handle;

a single piece faucet underbody, carried within said housing, comprising a unitary molded structure having a flat first bottom and an elongated second bottom contiguous to said flat first bottom, said flat first bottom being received by said main portion of said housing, said elongated second bottom being received by said outlet portion of said housing, said molded structure having a first tubular port and a second tubular port each having a top opening and a bottom opening, said bottom openings each defining an inlet for fluid, means for coupling said first port at said bottom openings to a first pipe and said second port at said bottom opening to a second pipe, means for coupling said first port and said second port at said top openings to said control valve, means defining an outlet in said molded structure, and a tubular waterway located within said molded structure, carried above said flat first bottom and said elongated second bottom, positioned to carry fluid from said first port and said second port to said outlet, whereby fluid entering said first port and said second port and passing through said control valve, by manipulation of said handle, is directed to said outlet.

6. A faucet as described in claim 5, wherein said elongated second bottom is shaped to fit flush into said second opening defined by said outlet portion of said housing.

7. A faucet comprising:

a housing having a main portion and an outlet portion, said main portion defining a first opening for a first bottom, said outlet portion defining a second opening for a second bottom;

a handle;

a control valve;

means attaching said control valve to said handle;

a single piece faucet underbody, carried within said housing, comprising a unitary molded structure having a flat first bottom and an elongated second bottom contiguous to said flat first bottom, said flat first bottom being received by said main portion of said housing, said elongated second bottom being received by said outlet portion of said housing, said molded structure having a first tubular port and a second tubular port each having a top opening and a bottom opening, said bottom openings each defining an inlet for fluid, means for coupling said first port at said bottom opening to a first pipe and said second port at said bottom opening to a second pipe, means for coupling said first port and said second port at said top openings to said control valve, means defining an outlet in said molded structure; and, a tubular waterway located within said molded structure, carried above said flat first bottom and said elongated second bottom, having a first leg, a second leg and a third leg, said first and second legs positioned to carry fluid from said first and second ports, respectively, to said third leg, said third leg positioned to carry fluid to said outlet, whereby fluid entering said first or second ports and passing through said control valve, by manipulation of said handle, is directed to said outlet.

8. A faucet as described in claim 7, wherein said elongated second bottom is shaped to fit flush into said second opening defined by said outlet portion of said housing.

9. A faucet comprising:

a housing having a main portion and an outlet portion, said main portion defining a first opening for a first bottom, said outlet portion defining a second opening for a second bottom;

a first handle;

a second handle;

a first control valve;

a second control valve;

means attaching said first and second control valves to said first and second handles, respectively;

a single piece faucet underbody, carried within said housing, comprising a unitary molded structure having a flat first bottom and an elongated second bottom contiguous to said flat first bottom, said flat first bottom being received by said main portion of said housing, said elongated second bottom being received by said outlet portion of said housing, said molded structure having a first tubular port and a second tubular port each having a top opening and a bottom opening, said bottom openings each defining an inlet for fluid, means for coupling said first port at said bottom opening to a first pipe and said second port at said bottom opening to a second pipe, means for coupling said first port at said top opening to said first control valve and said second port at said top opening to said second control valve, means defining an outlet in said molded structure; and, a tubular waterway located within said molded structure, carried above said flat first bottom and said elongated second bottom, having a first leg, a second leg and a third leg, said first and second legs positioned to carry fluid from said first and second ports, respectively, to said third leg, said third leg positioned to carry fluid to said outlet, whereby fluid entering said first or second ports and passing through said first or second control valves, by manipulation of said first or second handles, is directed to said outlet.

10. A faucet as described in claim 9, wherein said elongated second bottom is shaped to fit flush into said second opening defined by said outlet portion of said housing.

* * * * *